US010415350B2

(12) United States Patent
Radicioni et al.

(10) Patent No.: US 10,415,350 B2
(45) Date of Patent: Sep. 17, 2019

(54) UNDERWATER HYDROCARBON PROCESSING FACILITY

(71) Applicant: SAIPEM S.p.A., San Donato Milanese (IT)

(72) Inventors: Alessandro Radicioni, San Donato Milanese (IT); Fabrizio Gardini, San Donato Milanese (IT); Massimo Fontolan, Zero Branco (IT)

(73) Assignee: SAIPEM S.P.A., San Donato Milanese (IT)

( * ) Notice: Subject to any disclaimer, the term of this patent is extended or adjusted under 35 U.S.C. 154(b) by 0 days.

(21) Appl. No.: 15/546,570

(22) PCT Filed: Feb. 5, 2016

(86) PCT No.: PCT/IB2016/050605
§ 371 (c)(1),
(2) Date: Jul. 26, 2017

(87) PCT Pub. No.: WO2016/125114
PCT Pub. Date: Aug. 11, 2016

(65) Prior Publication Data

US 2018/0016877 A1 Jan. 18, 2018

(30) Foreign Application Priority Data

Feb. 5, 2015 (EP) ..... 15154035

(51) Int. Cl.
*E21B 43/017* (2006.01)
*E21B 43/36* (2006.01)
*E21B 43/01* (2006.01)

(52) U.S. Cl.
CPC ..... *E21B 43/0107* (2013.01); *E21B 43/017* (2013.01); *E21B 43/36* (2013.01)

(58) Field of Classification Search
CPC ..... E21B 43/0107; E21B 43/36; E21B 43/017
See application file for complete search history.

(56) References Cited

U.S. PATENT DOCUMENTS 4,438,817 A * 3/1984 Pokladnik ..... E21B 43/013 166/341
4,625,805 A * 12/1986 Ladecky ..... E21B 41/04 166/341

(Continued)

OTHER PUBLICATIONS

Offshore Technology Conference 24307 presentation "Steps to Subsea Factory" by O. Oekland et al, Oct. 29, 2013 (10 pages).

(Continued)

*Primary Examiner* — Matthew R Buck
(74) *Attorney, Agent, or Firm* — Neal, Gerber & Eisenberg LLP

(57) ABSTRACT

An underwater hydrocarbon processing facility has at least one fluid processing clusters provided with modules having, each, one fluid processing device and a plurality of first connection members configured to define the inlet and the outlet of the process fluids; and an interconnection unit having a plurality of second connection members defining inlet and outlet for the process fluids and configured to be operatively coupled to corresponding first connection members configured to operatively interconnect the modules.

19 Claims, 8 Drawing Sheets

(56) References Cited

U.S. PATENT DOCUMENTS

| | | | | |
|---|---|---|---|---|
| 4,848,475 | A * | 7/1989 | Dean | E21B 43/017 166/335 |
| 6,640,901 | B1 | 11/2003 | Appleford et al. | |
| 7,152,682 | B2 * | 12/2006 | Hopper | B01D 17/0217 166/357 |
| 8,550,170 | B2 * | 10/2013 | McHugh | E21B 33/037 166/264 |
| 9,145,750 | B2 * | 9/2015 | Borsheim | E21B 33/035 |
| 2004/0200620 | A1 | 10/2004 | Ostergaard | |
| 2004/0251030 | A1 * | 12/2004 | Appleford | E21B 33/038 166/357 |
| 2009/0200035 | A1 | 8/2009 | Bjerkreim et al. | |
| 2010/0119382 | A1 | 5/2010 | Scarsdale | |
| 2011/0155385 | A1 * | 6/2011 | Haheim | E21B 43/01 166/357 |
| 2012/0085276 | A1 | 4/2012 | Openshaw et al. | |
| 2012/0138307 | A1 | 6/2012 | Berg | |

OTHER PUBLICATIONS

Notification Concerning Submission, Obtention or Transmittal of Priority Document for International Application No. PCT/IB2016/050605 dated Jun. 8, 2016.

International Search Report and Written Opinion for International Application No. PCT/IB2016/050605 dated Apr. 8, 2016.

PCT Demand for International Preliminary Examination and Reply to International Search Report and the associated Written Opinion for International Application No. PCT/IB2016/050605 dated Dec. 5, 2016.

Notification of Receipt of Demand by Competent International Preliminary Examining Authority (Form PCT/IPEA/402) for International Application No. PCT/IB2016/050605 dated Dec. 9, 2016.

Notification of Transmittal of the International Preliminary Report on Patentability (Form PCT/IPEA/416) for International Application No. International Application No. PCT/IB2016/050605 dated Jan. 17, 2017.

* cited by examiner

UNDERWATER HYDROCARBON PROCESSING FACILITY

PRIORITY CLAIM

This application is a national stage application of PCT/IB2016/050605, filed on Feb. 5, 2016, which claims the benefit of and priority to EP Patent Application No. 15154035.8, filed on Feb. 5, 2015, the entire contents of which are each incorporated by reference herein.

TECHNICAL FIELD

The present disclosure concerns an underwater hydrocarbon processing facility.

In particular, the present disclosure concerns an underwater hydrocarbon processing facility configured to process fluids deriving from the hydrocarbon extraction from underwater wells. The underwater processing facilities can be located either relatively close to the underwater wells or to the topside or in intermediate locations. Further, the underwater hydrocarbon processing facility can be set on a bed of body of water in different locations along the bed depending on the selected underwater field development scheme.

BACKGROUND

The concept of underwater hydrocarbon processing facilities has been developed by different operators with the aim of streamlining the production of hydrocarbon from underwater wells. In general, the underwater hydrocarbon processing facility is part of a plant including topside hydrocarbon processing facilities, and long distance transport pipelines. The exploitation of underwater oil and/or gas hydrocarbon reservoirs, through underwater hydrocarbon processing facilities, foreseeing the collection and transport of the hydrocarbon up to topside facilities or to shore, is known. The development of underwater hydrocarbon processing facilities has rapidly increased in recent years and it is likely to boom in the near future. These underwater hydrocarbon processing facilities can be located from shallow to deepwater and in any geographical areas of the world in mild or harsh environment. The topside facilities can be located on offshore fixed or floating vessels or onshore and that can be relatively near, relatively far or relatively very far from the reservoir. The underwater field development schemes/configurations have become more complex because of the increasing number of requirements and by the need of reducing the project development costs to make the exploitation of the fields economically attractive. This issue is even more important in deepwater and/or when the topside facilities are relatively far or relatively very far from the field.

The recent developments of underwater technology processing devices and the great interest of oil companies boosted the feasibility of complex schemes. For examples, the recent development of underwater active processing devices broadens the potentiality of the underwater hydrocarbon processing facilities to cover nearly all the processes of a plant. The active underwater processing devices are configured to perform the following activities: boosting the hydrocarbon (single or multiphase), separation or water treatment or combination of these processes. Consequently the main underwater processing activities are the following: liquid boosting, multiphase boosting, underwater separations (liquid/liquid, Gas/liquid, oil/water/gas), wet or dry gas boosting, water treatment, heat exchange and injection.

Prototypes of underwater processing devices were designed and built since the 1970's but the first industrial applications were performed in the 1990's starting with single phase and multiphase subsea pumps. In the 2000's the first subsea separation station was installed in the North Sea. However, underwater processing devices still have limited Mean Time Between Maintenance (MTBM) and require frequent intervention. Moreover, underwater hydrocarbon processing facilities have to be adapted to the evolution of the field because the process parameters change during the field life. Adaption means changing and/or expanding the production rate of the underwater hydrocarbon processing facilities that shall be configured to fulfill also this need. The oil companies exploiting the fields have the goals of increasing the production uptime and reducing the lifecycle costs (CAPEX+OPEX).

Additional information on the current status of underwater hydrocarbon processing facilities can be found in the OTC 24307 paper "STEPS TO SUBSEA FACTORY" by Rune Mode Ramberg (Statoil), Simon R. H. Davies (Statoil), Hege Rognoe (Statoil), Ole Oekland (Statoil).

Many advantages correlated to underwater hydrocarbon processing facilities are listed in the above-reference paper that, among others, includes:

- Increase hydrocarbon recovery and accelerate production;
- Greater energy efficiency because the location is closer to wells;
- Increase lifetime of existing installations;
- Reduce topsides space and weight when starting up new subsea fields.

While underwater hydrocarbon processing facilities bring many great advantages, the downsides are that the construction and the maintenance of an underwater hydrocarbon processing facility are rather complex with a degree of complexity that increases with the water depth or with the peculiar characteristics of the hydrocarbon field. The underwater hydrocarbon processing facilities are currently configured and built in accordance to two types of architecture: the single block architecture, and the multiple blocks architecture. The underwater hydrocarbon processing facilities organized according to the single block architecture have the drawback of being relatively heavy and each processing device is hardly replaceable by an analogous device. The underwater hydrocarbon processing facilities organized according to the multiple blocks architecture, such as that disclosed in U.S. Pat. No. 6,640,901, call instead for a large number of connections between blocks and the interfaces between blocks and are thus rather relatively complicated.

In addition to that, both architectures do not offer an adequate flexibility for relatively easily adapting the underwater hydrocarbon processing facility to different demands. Furthermore, installation, inspection, maintenance and retrieval of blocks can be particularly relatively demanding tasks.

SUMMARY

It is an advantage of the present disclosure to provide an underwater hydrocarbon processing facility that mitigates certain of the drawbacks of certain of the prior art.

According to the present disclosure there is provided an underwater hydrocarbon processing facility, the facility comprising at least one cluster configured to process the process fluids including liquids and/or gases deriving from hydrocarbon extraction process, the cluster comprising:

at least two modules, each comprising one fluid processing device and a plurality of first connection members configured to define the inlet and the outlet of the process fluids; and an interconnection unit configured to be set on the bed of the body of water and including a plurality of second connection members defining inlet and outlet for the process fluids and configured to be operatively coupled to corresponding first connection members configured to operatively interconnect said modules; a plurality of pipes, each extending between a couple of second connection members; valves configured to adapt the interconnection unit to operate with different quantities or numbers of modules; and a subsea control module configured to elaborate signals acquired from the modules to emit control signal configured to control the modules and to open and close said valves.

In other words, the process fluids flow in and out the cluster through the interconnection unit only. The interconnecting unit can also interface directly with manifolds, or underwater well equipment like X-mas trees.

The interconnection unit according to the present disclosure provides many advantages: it permits arranging an underwater hydrocarbon processing facility in accordance to a new type of architecture that, is at the same time relatively compact and allows flexibility; it renders relative easy operatively coupling the first and second connection members to the benefits of the relative quick interchangeability of modules; and enhance standardization of interfaces between first and second connection members. At the same time, the interconnection unit according to the present disclosure allows a significant optimization and reduction of interfaces, integrates manifolding functions including inlet and outlet facilities and any non-critical pipework outside the standard modules, and it can be relatively conveniently tested onshore before deployment.

In view of the above, the interconnection unit favors the modularization of and helps in reducing modules dimensions and weights. De facto, the interconnection unit is the sole part of the cluster that is customized to the need of a designated or given gas/oil field and allows interconnecting several modules performing different processes or even the same process. When at least two modules perform the same process, these modules operate in parallel or in series and are interconnected in parallel or in series, as required, by the interconnection unit.

If, on the one side, the interconnection unit has a substantially passive function of conveying process fluids, chemicals, and possibly hydraulic fluids, on the other side, has an active function in controlling the modules that are connected to the same interconnection unit.

In particular, each module hosts one processing device selected from the following fluid processing devices:

a single hydrocarbon pressure boosting device;
multiphase pump device;
liquid pump device;
gas compression device;
scrubber device;
liquid/liquid separation device;
gas/liquid separation device;
solid/water separation device;
heat exchanging device;
water injection pump device;
chemical injection device;
gas treatment device;
oil treatment device;
water treatment device.

In practice, any processing device can be standardized in function and even in size to enable interchangeability.

In particular, the interconnection unit houses a plurality of first pipes, each one extending at least from one second connection member to another second connection member and configured to operatively convey the process fluids between modules.

In other words, the interconnection unit has the function of operatively and fluidically connecting the modules hosting the respective processing devices and in performing this function is a substantially passive block.

In particular, each module comprises a first frame housing the respective processing device, and the interconnection unit comprises a second frame larger than the first frame so as to enable simultaneously arranging of the interconnection unit in a face to face configuration with a plurality of modules.

According to the present disclosure the processing devices and the pipes are supported and housed in respective first and second frames, which to certain extent protects the processing device and the pipes.

In particular, the first and the second frames are open frames and are configured as a parallelepiped, in particular as a rectangular parallelepiped.

The parallelepiped shapes of interconnection unit and modules enable combining them as building blocks and arranging them in side by side configuration and render possible retrieving the modules and, if foreseen and necessary, the interconnection unit. Alternatively the building blocks can be also interfaced on top of the interconnection unit.

In addition to that, the first and the second frames are configured to be directly or indirectly mechanically coupled to one another.

The mechanical coupling of frames defines a precise spatial relationship between first and second frame so that it possible to define a layout of first and second connection members beforehand.

In particular, the interconnection unit comprises a platform, which stably supports the second frame and is configured to guide each one of the first frames, when lowered on the platform, in a designated or given position on a side of the second frame and in close proximity to the second frame so as to align each first connection member to a second corresponding connection member; the first and second connection members projecting from the facing lateral side of the respective first and second frames.

The platform is relatively stable and defines an even support for the first and second frames. According to this connection method the module is lowered in close proximity of the second frame.

According to another connection method, the interconnection unit comprises a sledge configured to slide on the platform towards and away from the second frame; the sledge being configured to guide one of the first frames, when lowered on the sledge, in a designated or given position on a side of the second frame so as to align each first connection member to a corresponding second connection member; the first and second connection members projecting from the facing lateral side of the respective first and second frames.

This connection method requires lowering the module and displacing the module towards the second frame.

Another connection method consists in lowering the module on top of the second frame of the interconnection unit. In this case the second frame is configured to support the first frame located on top of the second frame and to guide the first frame, when lowered on the second frame, in a designated or given position on top of the second frame so as to align each first connection member to a corresponding second connection member; the first and second connection members projecting from the facing bottom face and top face of the respective first and second frames.

Irrespective of the connection method the mechanical coupling is, in certain embodiments, achieved by mutually engaging guide posts and guide engaging members. In particular, the interconnection unit comprises the guide posts, whereas each second frames comprises guide engaging members, in particular guide funnels, configured to mechanically couple the first frame to the interconnection unit.

In particular, the first connection members are arranged along a first face of the first frame in accordance to a designated or given interface layout matching with a designated or given interface layout of the second connection members in the second frame.

This arrangement of interface layouts of the first and second connection members for the process fluids renders relatively easier the connection and enhances standardization.

In particular, the interconnection unit comprises a plurality of control cables and a quantity or number of junction plates configured to connect the control cables to the modules.

The interconnection unit can relatively conveniently have the additional function of exchanging control signals with each module with the advantage of relatively simplifying the connections of control cables.

In particular, the interconnection unit comprises a plurality of tubes configured to convey chemicals and/or hydraulic fluids and a quantity or number of junction plates configured to connect the tubes to the modules.

Chemicals are often used in the processes of a hydrocarbon processing facility, whereas hydraulic fluids are sometimes optional and are used for actuating and controlling the modules. According to the present disclosure, the distribution of chemicals and the hydraulic fluids to the modules can be conveniently accomplished by the interconnection unit.

In particular, the junction plate comprises a quantity or number of electrical connectors connected to a corresponding quantity or number of control cables; and a number of tube connectors connected to a quantity or number of tubes.

Conveniently, junction plates can enhance standardization.

In particular, the subsea control module is further connected to an umbilical in order to exchange information with a surface control station.

According to a particular aspect of the present disclosure, each module comprises a further subsea control module configured to control parameters correlated to the respective process. The further subsea control module operates as a slave. The function of master can be performed by the subsea control module of the interconnection unit or by a surface control station.

Additional features and advantages are described in, and will be apparent from the following Detailed Description and the figures.

BRIEF DESCRIPTION OF THE DRAWINGS

A number of non-limiting embodiments of the present disclosure will be described by way of example with reference to the attached drawings, in which.

DETAILED DESCRIPTION

Figure 1:
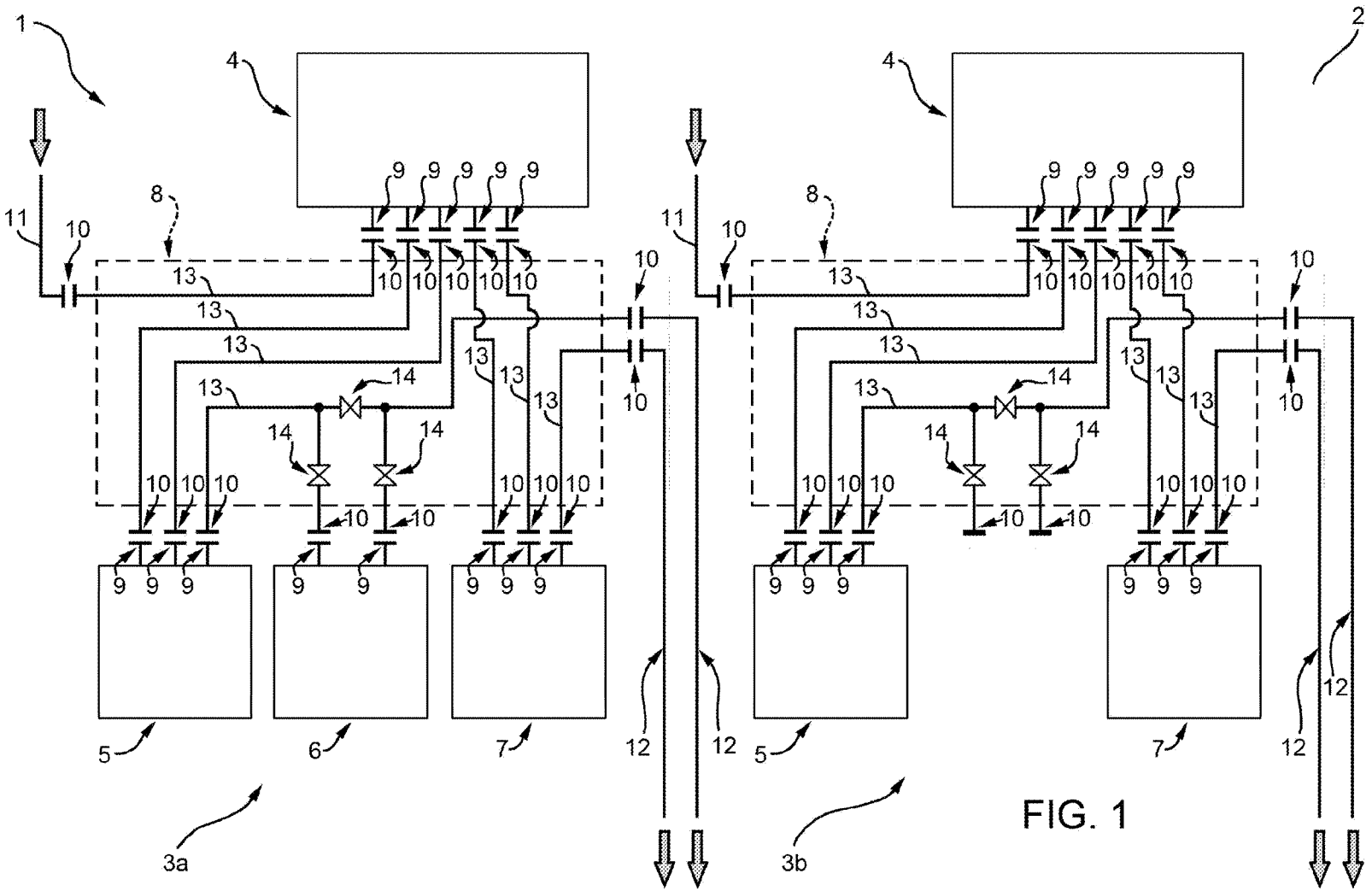
FIG. 1 shows a schematic plan view, with parts removed for clarity, of an underwater hydrocarbon processing facility in accordance with a first embodiment of the present disclosure including two clusters each comprising an interconnection unit and a plurality of modules connected to the interconnection unit.

Referring now to the example embodiments of the present disclosure illustrated in FIGS. 1 to 17, number 1 in FIG. 1 indicates an underwater hydrocarbon processing facility configured to process hydrocarbon on a bed 2 of the body of water in proximity of an underwater well (not shown in the enclosed Figures). Facility 1 comprises two clusters 3*a* and 3*b* arranged in parallel between a multiphase manifold (not shown) and a gas manifold (not shown) and a liquid manifold (not shown). In the example, cluster 3*a* comprises four modules 4, 5, 6 and 7, an interconnection unit 8 configured to be set on the bed 2 of the body of water configured to operatively interconnect modules 4, 5, 6, and 7. Each one of modules 4, 5, 6, and 7 comprises a plurality of connection members 9, whereas the interconnection unit 8 comprises a plurality of connection members 10, each configured to be operatively coupled to a corresponding connection member 9 of one of the modules 4, 5, 6 and 7 configured to operatively and mutually interconnect modules 4, 5, 6 and 7. Interconnection unit 8 comprises a further connection member 10 configured to connect to an inlet pipeline 11 from multiphase manifold (not shown) and two further connection member 10 configured to connect to respective two outlet pipelines 12 leading to respective gas and liquid manifolds (not shown).

In the example shown cluster 3*b* comprises three modules 4, 5, and 7, and the interconnection unit 8 which has been adapted for being connected with a lower quantity or number of modules.

Each one of the modules 4, 5, 6 and 7 houses one device configured to process the hydrocarbon or configured to perform operations correlated to hydrocarbon processing. In general, these devices (functional building blocks performing a single process function/task) include:

multiphase pump device
liquid pump device
gas compression device;
scrubber device;
liquid/liquid separation device;
gas/liquid separation device;
solid/water separation device;
heat exchanging device;
water injection pump device;
chemical injection device;
gas treatment device;
oil treatment device;
water treatment device.

In the example disclosed in FIG. 1, module 4 houses a gas/liquid separation device, module 5 houses a liquid pump device, module 6 houses a chemical injection device, and module 7 houses a gas compressor device.

The interconnection unit 8 comprises a plurality of pipes 13, each extending between a couple of connection members 10, and valves 14 configured to adapt the interconnection unit 8 to operate with different quantities or numbers of modules.

Figure 2:
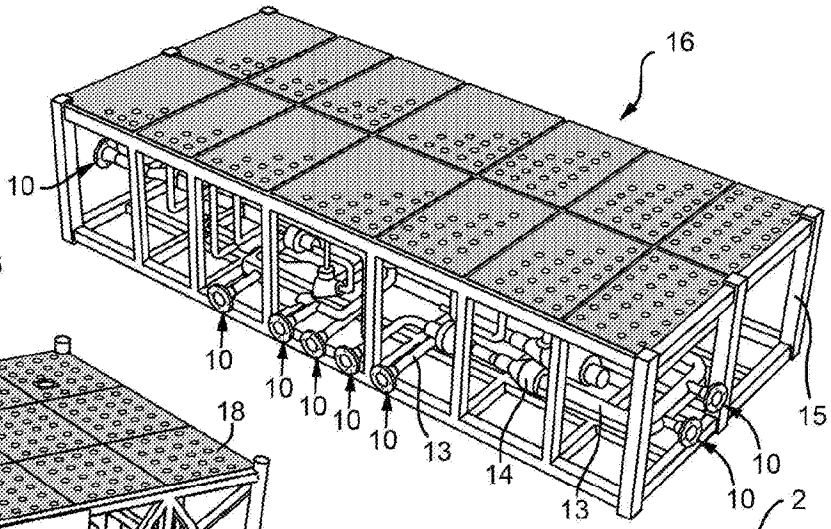
FIG. 2 shows a larger-scale perspective and more detailed view, with parts removed for clarity, of an example of an interconnection unit of the type used in the embodiments of FIG. 1.

With reference to FIG. 2, with reference numeral 16 is indicated an interconnection unit comprising a frame 15 configured to support pipes 13, valves 14 and connections members 10. In particular, frame 15 is open, in other words has a cage-like structure that defines a space having the shape of a rectangular parallelepiped, the bottom face of which is configured to be set on the bed 2 of the body of water. Pipes 13 are substantially confined in the rectangular parallelepiped, whereas connection members 10 project from the rectangular parallelepiped along the lateral faces.

Figure 3:
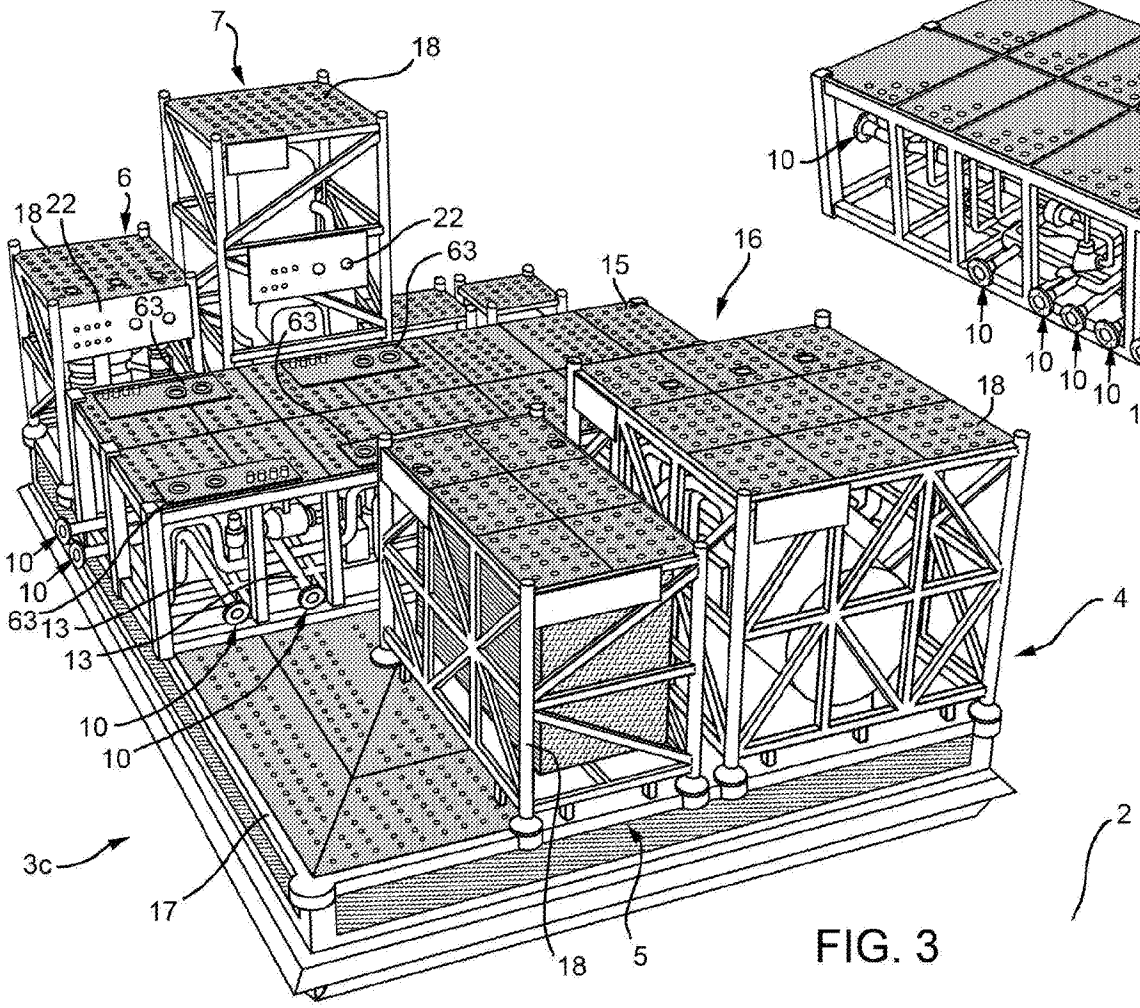
FIGS. 3 show a larger-scale view in perspective, with parts removed for clarity, of an example of a cluster.

FIG. 3 shows an example of a cluster 3*c* comprising a interconnection unit 16 comprising a platform 17, which supports the modules 4, 5, 6, and 7 with a designated or given layout different from the layouts disclosed in the previous examples of clusters 3*a* and 3*b*. Interconnection unit 16 comprises a frame 15 and differs from interconnection unit 8 just for the arrangement of pipes 13 and connection members 10. Modules 4, 5, 6, and 7 comprise respective frames 18 configured to support respective processing devices and connection members 9 (not shown in FIG. 3). In particular, frame 18 is open, in other words has a cage-like structure that defines a space having the shape of a rectangular parallelepiped. Processing devices are substantially confined in the respective parallelepiped frames 18, whereas connection members 9 slightly projects from the rectangular parallelepiped frames 18 along one lateral face (not shown in FIG. 3).

Figure 4:
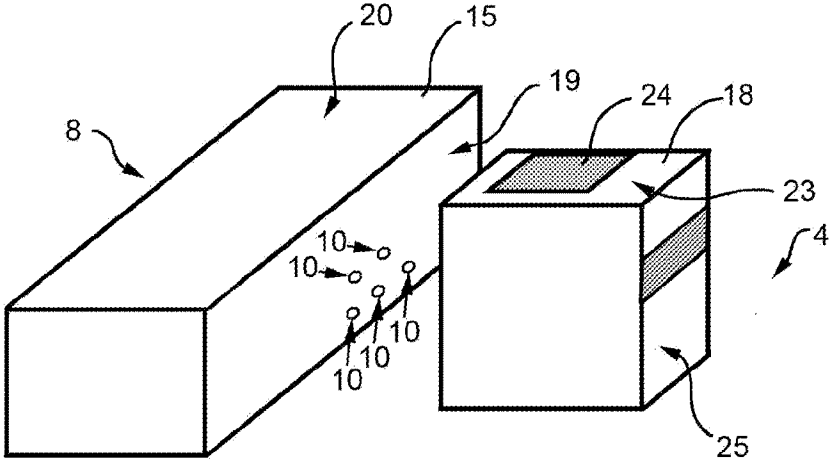
FIG. 4 shows a schematic perspective view, with parts removed for clarity, of a cluster of FIG. 1 interconnection unit and a module.

The description of module 4 in FIGS. 4-8 and the description of interconnection unit 8 in FIG. 4 apply to other modules and to other interconnection units disclosed in this description, unless otherwise provided.

With reference to FIG. 4, interconnection unit 8 and module 4 are schematized as rectangular parallelepiped. The interconnection unit 8 has long lateral faces 19 and a long top face 20, that are, in certain embodiments, adapted to be connected to module 4. Module 4 is generally higher than the interconnection unit 8 and is, in certain embodiments, connected to the interconnection unit 8 side by side along one lateral face 19 of the interconnection unit 8.

In general, each module 4 has at least two connection members 9 arranged along the same face: a connection member 9 that defines the inlet of a fluid to be processed and a connection member 9 that defines the outlet of a processed fluid. The process fluids can be either gases or liquids or both. Beside the basic configuration of modules with just two connection members 9, there are provided modules with several connection members 9 configured to process gases and liquids.

Figure 5:
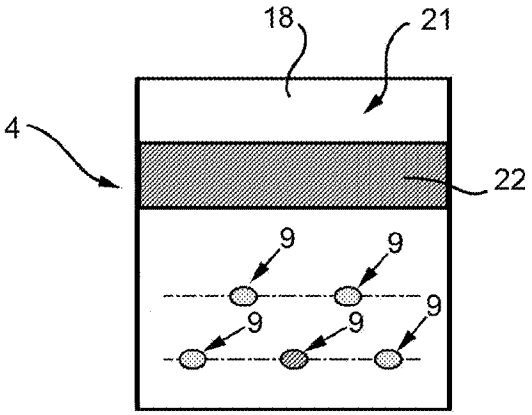

In accordance to the example shown in FIG. 5, the frame 18 of module 4 has a lateral face 20 along which connection members 9 are arranged in accordance to a designated or given interface layout configured to fit to connection members 10 of interconnection unit 8 (FIG. 4). According to the interface layout of FIG. 5, connection members 9 for liquids are arranged at the lower level along face 2 and at a designated or given distance from bottom line of face 21; connection members 9 for gas are arranged at another designated or given distance above the connection members 9 for liquids. In particular, connection members 9 for liquid are arranged in a row parallel to bottom line, and connection members 9 for gas are arranged in a further row and are offset with respect to connection members 9 for liquids so as to ease access to each connection member 9. In particular, connection members 9 are distributed with designated or given spacing between piping centerlines along the same row so as to enable adequate access for remotely operated underwater vehicle ("ROV") closure.

Frame 18 is higher than frame 15 (FIG. 4) to such an extent so that face 21 has an upper portion projecting from the interconnection unit 8, and a bottom portion configured to face the interconnection unit 8. Frame 18 supports a junction plate 22 along the upper portion of face 21. The junction plate 22, which is of at least 1.5 m high, extends, in certain embodiments, for the entire width of face 21, and is located at least 1 m above the top face 20 of the interconnection unit 8 (FIG. 4) when module 4 is connected to interconnection unit 8. The junction plate 22 carries chemicals hydraulic fluid tubes, electrical connectors, and a ROV parking positions.

Figure 6:
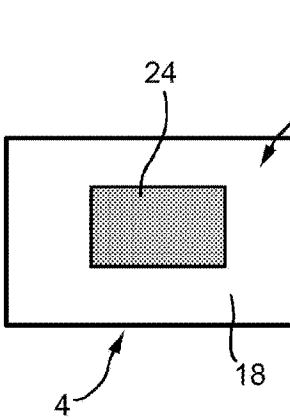
FIGS. 5, 6 and 7 show a schematic view, with parts removed for clarity, of interface layouts along respective faces of a module.

FIG. 6 shows the top face 23 of frame 18 of module 4. Frame 18 supports a subsea control module 24, which is independently retrievable and extends along the top face 23.

Figure 7:
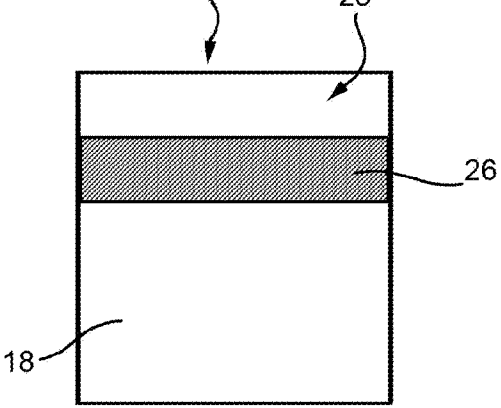
Figure 8:
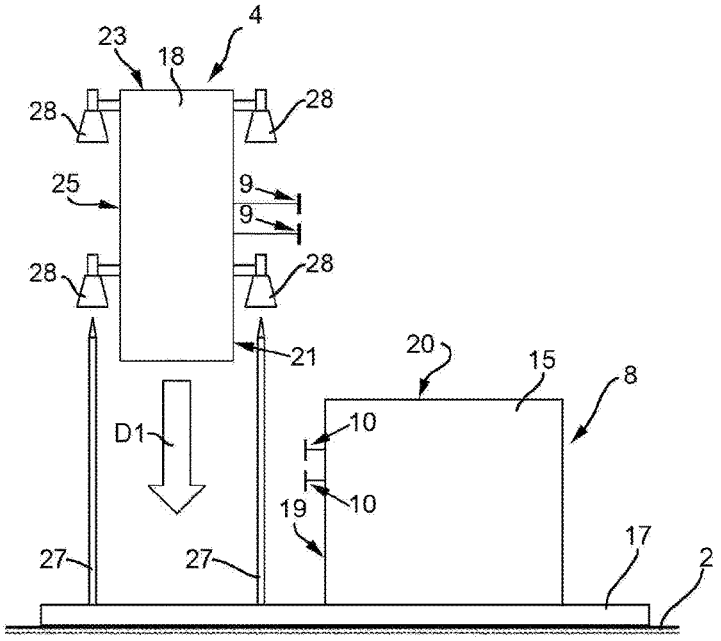
FIGS. 8 and 9 show schematic side views, with parts removed for clarity, of a first method for connecting a module to the interconnection unit.

FIG. 7 shows a lateral face 25 of the frame 18 opposite to lateral face 21 of FIG. 8. Frame is optionally structured for supporting a junction power plate 26 along face 25 for connection power cable (not shown in FIG. 7). The power junction plate 26 basically supports electrical connectors, extends, in certain embodiments, across the whole width of face 25, and is arranged at a designated or given distance the bottom line of the face 25.

With reference to FIG. 1, the interface layout of connections members 10 along the interconnection unit 8 matches with the interface layouts of connections members 9 of all modules 4, 5, 6, and 7, which the interconnection unit 8 has been configured for. Interconnection unit 8 and module 4, 5, 6, and 7 are configured to be mutually mechanically coupled to one another so as to simplify the alignment and the coupling of connection members 9 and 10.

For this purpose and with reference to Figures from 8 to 14, frames 15 and 18 are configured to be mechanically coupled to one another directly or indirectly in order to define designated or given relative spatial positions between frame 15 and frame 18 and to arrange a connection member 9 in front of a corresponding connection member 10 and in close proximity of the corresponding connection member 10.

Figure 9:
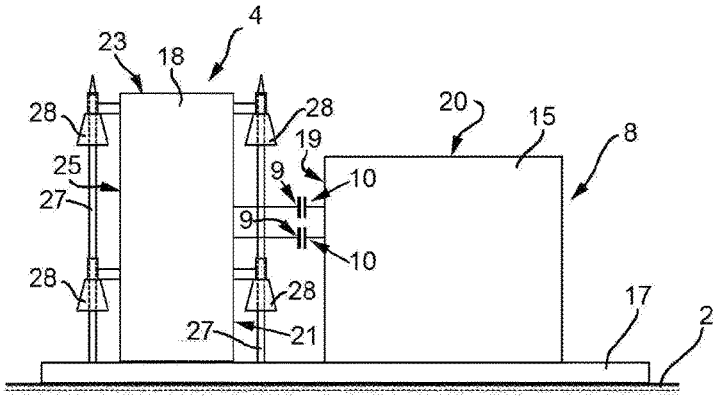

In FIGS. 8 and 9 interconnection unit 8 comprise a platform 17, and frame 15 is mounted on the platform 17, which is configured to stably and mechanically couple to the frame 18 of module 4 in order to define designated or given relative spatial positions between frame 15 and frame 18. In practice, platform 17 is provided with at least three guide posts 27 (only two of them shown in FIGS. 8 and 9) perpendicular to platform 17, whereas each frame 18 is provided with guide engaging members 28 configured to be engaged by guide posts 27 so as to define a designated or given position for the module when frame 18 is lowered onto platform 17 in direction D1. Each guide engaging member 28 is funnel-shaped for easing the engagement with the corresponding guide post 27.

When the module 4 is completely lowered onto platform 17 as shown in FIG. 9, each connection member 9 is facing a corresponding connection member 10 and is in close proximity to the corresponding connection member 10 configured to couple to the corresponding connection member 10.

The above-described connection method is applicable to all type of environment (mild/harsh).

Figure 10:
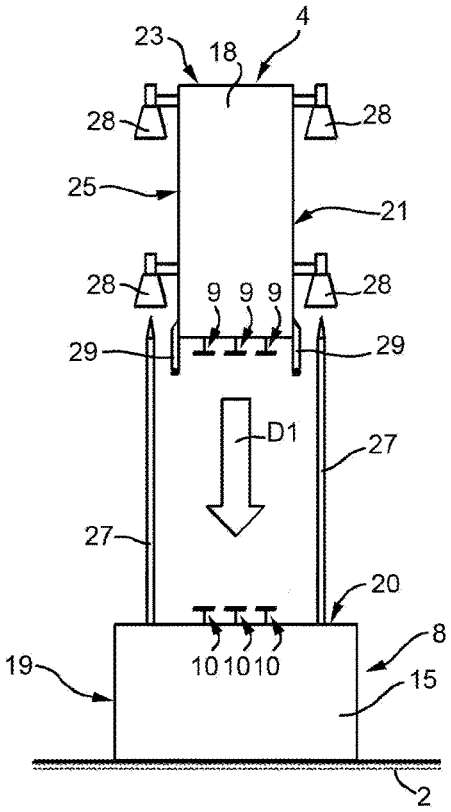
FIGS. 10 and 11 show schematic side views, with parts removed for clarity, of a second method for connecting a module to an interconnection unit.
Figure 11:
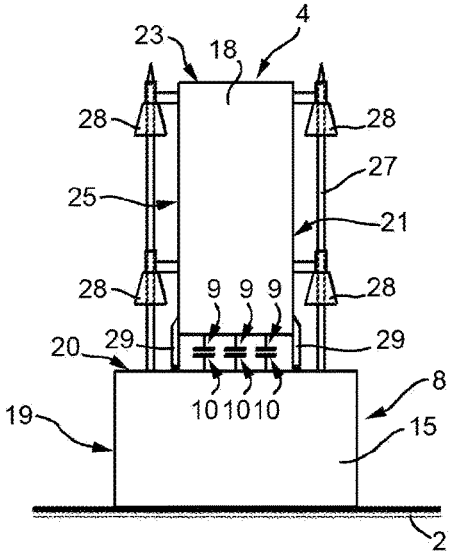

FIGS. 10 and 11 disclose an alternative cluster layout in which a variation of module 4 is mounted directly atop interconnection unit 8 configured according to a variation. According to this embodiment, interconnection unit 8 and each module 4 face each other along the top face and the bottom face of respective frames 15 and 18. Therefore, connection members 10 projects from the top side of frame 15, whereas connection members 9 project from the bottom side of frame 18. Guides posts 27 are mounted on frame 15 along the top face of the same. Frame 15 is reinforced in order to bear the load of module 4, and each frame 18 is provided with legs 29 configured to keep the bottom face of frame 18 spaced apart from top face of frame 15.

In FIG. 10, frame 18 is lowered in direction D1 on frame 15 with the guide engaging members 28 aligned to guides posts 27. When frame 18 rests on top frame 15 as shown on FIG. 11, each connection member 9 is aligned to/and in close proximity of a corresponding connection member 10.

In particular, this connection method is applicable for mild environment and deep-water projects (deeper than 1000 m) where there is no fishing interaction and limited risk of damaging the connections during the landing module 4.

Figure 12:
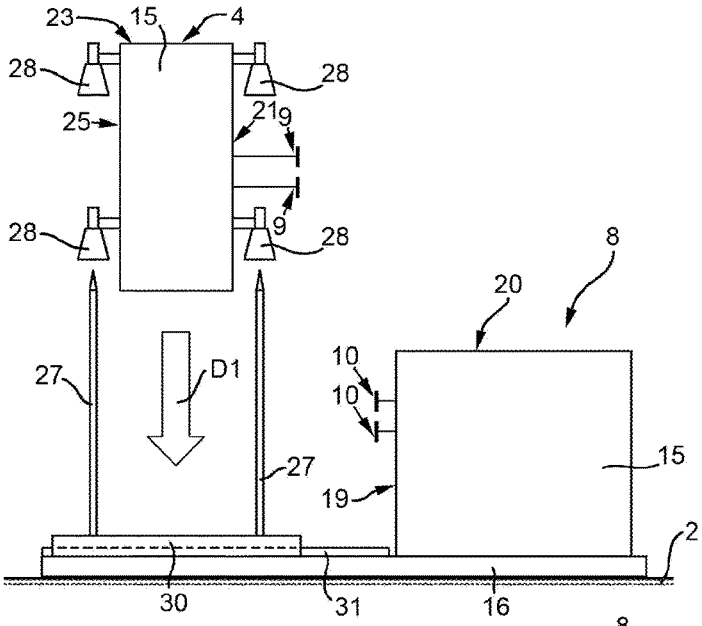
FIGS. 12, 13 and 14 show schematic side views, with parts removed for clarity, of a third method for connecting a module to an interconnection unit.
Figure 13:
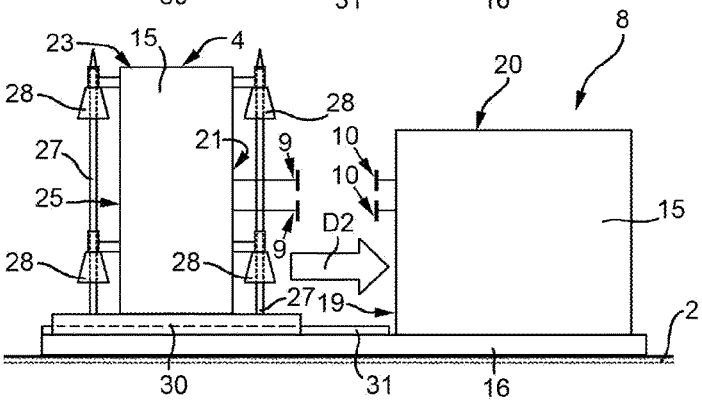
Figure 14:
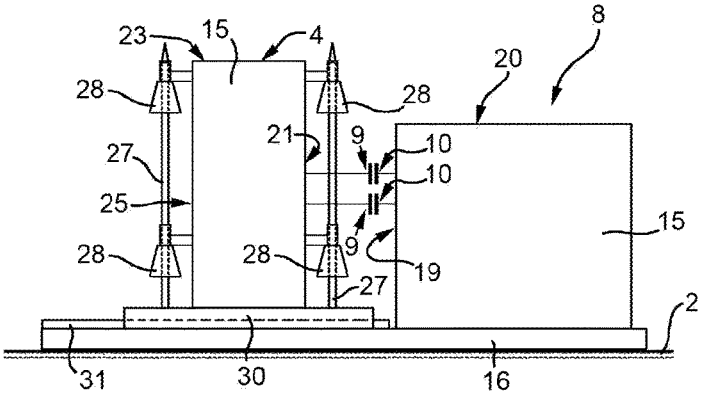

FIGS. 12, 13 and 14 disclose a variation of the connection method of FIGS. 8 and 9 in which module 4 and interconnection unit 8 are mounted in a side by side relationship. In accordance to this variation platform 17 carries a sledge 30 configured to move along guides 31 towards and away from a lateral face of frame 15 along which connection members 10 are arranged. Sledge 30 supports the guide posts 27 that are configured to be engaged by the guide engaging members 28 of frame 18.

Starting from a position in which sledge 30 is relatively remote from frame 15 (FIG. 12), module 4 is lowered on sledge 30 in direction D1, then sledge 30 and the module 4 are displaced in direction D2 toward frame 15 (FIG. 13) until to the position disclosed in FIG. 14, in which each connection member 9 is aligned and close to, and in a face to face configuration with a corresponding connection member 10.

In particular, this connection method is applicable only for smaller modules (below 70 T).

Figure 15:
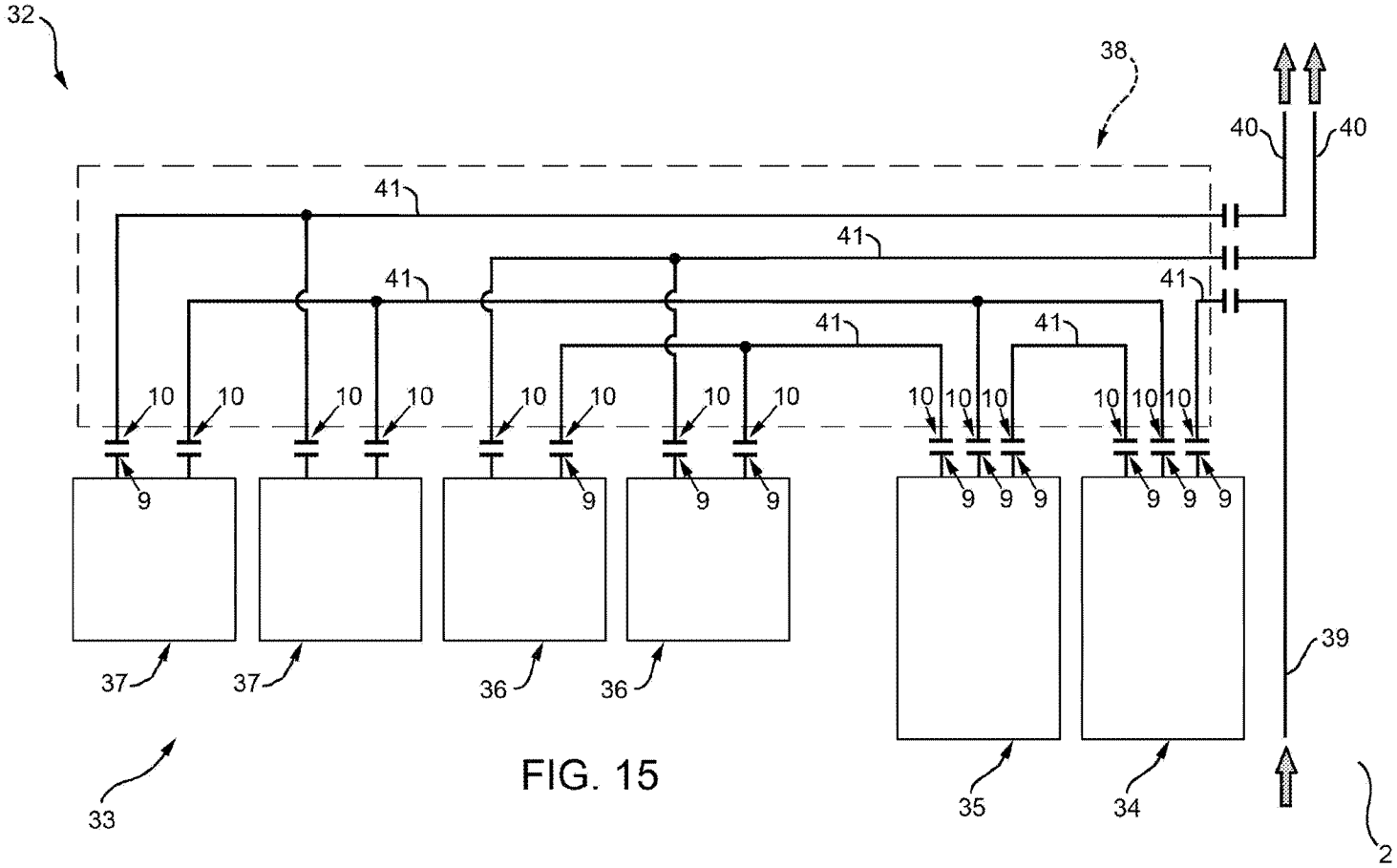
FIG. 15 shows a schematic plan view, with parts removed for clarity, of an underwater hydrocarbon processing facility in accordance with a second embodiment of the present disclosure including a single cluster and a plurality of modules connected to an interconnection unit.

FIG. 15 discloses another embodiment of an underwater hydrocarbon processing facility 32 including a cluster 33 comprising modules 34, 35, 36, and 37, an interconnection unit 38 configured to be set on the bed 2 of the body of water and configured to operatively interconnect modules 34, 35, 36, and 37. Each one of modules 34, 35, 36, and 37 comprises a plurality of connection members 9, whereas the interconnection unit 38 comprises a plurality of connection members 10, each configured to be operatively coupled to a corresponding connection member 9 of one of the modules 34, 35, 36 and 37 configured to operatively and mutually interconnect modules 34, 35, 36 and 37. Interconnection unit 38 comprises a further connection member 10 configured to connect to an inlet pipeline 39 from multiphase manifold (not shown) and two further connection member 10 configured to connect to respective outlet pipelines 40 leading to respective hydrocarbon and water manifolds (not shown).

In particular module 34 houses a gas/liquid separation device, module 35 houses a liquid/liquid separation device, modules 36 house respective water injection pumps working in parallel, and modules 37 house respective multi-phase pumps working in parallel.

The interconnection unit 8 comprises a plurality of pipes 41 including one or more bifurcation configured to connect modules operating in parallel.

Figure 16:
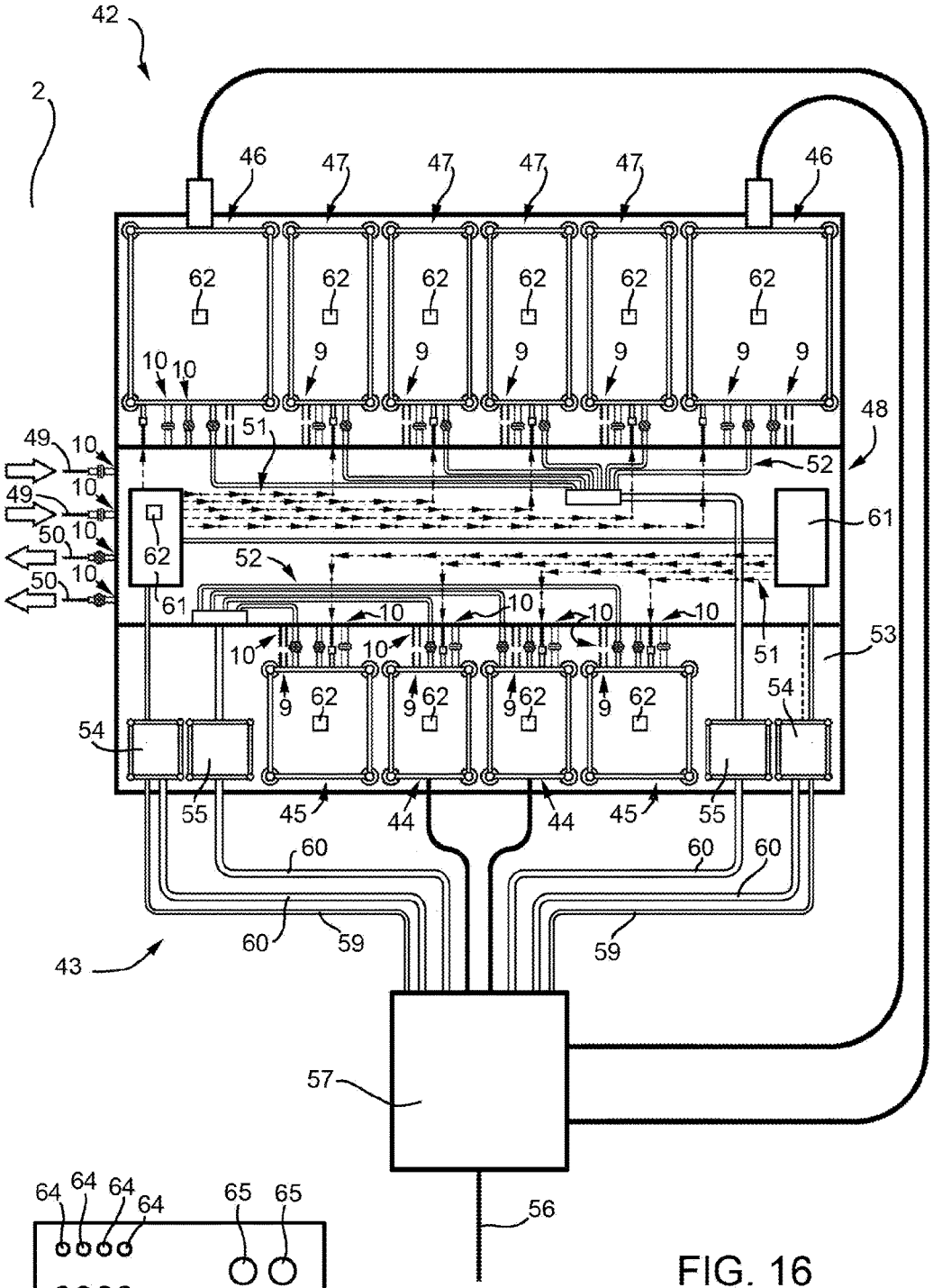
FIG. 16 shows a schematic plan view, with parts for clarity, of underwater hydrocarbon processing facility in accordance with a further embodiment of an underwater hydrocarbon processing facility of the present disclosure.

With reference to the embodiment of FIG. 16, number 42 indicates an underwater hydrocarbon processing facility comprising a cluster 43 comprising a plurality of modules 44, 45, 46 and 47; and an interconnection unit 48 configured to be set on the bed 2 of the body of water configured to operatively interconnect modules 44, 45, 46, and 47. Each one of modules 44, 45, 46, and 47 comprises a plurality of connection members 9, whereas the interconnection unit 48 comprises a plurality of connection members 10, each configured to be operatively coupled to a corresponding connection member 9 of one of the modules 44, 45, 46 and 47 configured to operatively and mutually interconnect modules 44, 45, 46 and 47. Interconnection unit 48 comprises further connection members 10 configured to connect to inlet pipelines 49 from multiphase manifold (not shown) and two further connection members 10 configured to connect to respective two outlet pipelines 50 leading to respective manifolds (not shown).

Connection members 10 are interconnected by pipes (not shown in FIG. 16) and housed in the interconnection unit 48, and configured to convey process fluids between modules 44, 45, 46, 48, inlet pipelines 49 and outlet pipelines 50 in accordance with a designated or given scheme. Interconnection unit 48 comprises also valves (not shown in FIG. 16) and located along pipes (not shown in FIG. 16).

The interconnection unit 48 is configured to distribute and collect signals, chemicals and hydraulic fluids to and from modules 44, 45, 46, and 47. Consequently, the interconnection unit 48 comprises a plurality of control cables 51; and a plurality of tubes 52 configured to convey chemicals and/or hydraulic fluids.

The interconnection unit 48 comprises a platform 53 which is configured to support the modules 44, 45, 46 and 47; two control distribution units 54; and two chemical distribution units 55.

Signals, chemicals, hydraulic fluids and electric power are conveyed through an umbilical 56 to an umbilical switching unit 57, which distributes the electric power directly through power cables 58 to modules 44 and 46 hosting powered processing devices such as pumps or compressors.

The umbilical switching unit 57 is connected to the two control distribution units 54 by a bundle of control cables 59 and a bundle 60 of tubes for hydraulic fluids; and to chemicals distribution units 55 by bundle 60 of tubes for chemicals.

The control distribution units 54 and the chemicals distribution units 55 are in turn connected to the interconnection unit 48.

The interconnection unit 48 disclosed in FIG. 16 comprises two junction boxes 61; and a subsea control module 62 configured to elaborate signals acquired from the modules 44, 45, 46, and 47; to emit control signal configured to control the modules 44, 45, 46, and 47, and to open and close valves (not shown in the Figures).

Each one of the modules 44, 45, 46, 47 comprises a subsea control module 62 configured to control parameters correlated to the respective process.

In particular, the subsea control module 62 of the interconnection unit 48 has the function of master and is connected to all subsea control modules 62 installed in the modules 44, 45, 46, and 47. The subsea control modules 62 of the modules 44, 45, 46, and 47 have the function of slave with respect subsea control module 62 installed in the interconnection unit 48.

The entire supervision of the underwater hydrocarbon processing facility 42 is in any case performed by a surface control station (not shown in the Figures).

Figure 17:
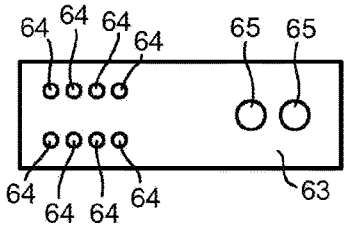
FIG. 17 shows an elevation view, in enlarged scale, of a detail of the underwater hydrocarbon processing unit of FIG. 16.

The electrical and fluid connection between interconnection 48 and modules 44, 45, 46, and 47 are achieved by junction plates 63 disclosed in FIG. 17.

With reference to FIG. 17, each junction plate 63 comprises either electrical connectors 64 or tube connectors 65. The arrangement of the connectors 64 and 65 can be set in accordance to a designated or given scheme configured to improve standardization.

Junction plates 63 can be arranged on the lateral side of the interconnection unit 48 or on the top of the same and are connected to junction plate 22 of FIG. 5 by jumpers (not shown in the Figures) or even directly.

Also the modular construction of the facility 42 enables enhancing standardization of junction plate 22.

The additional functions described in connection with the interconnection unit 48 are applicable to any one of the interconnection units 8, 16, 38 previously described. In FIG. 3, are shown also junction plates 63 and junction plate 24.

Clearly, changes, not described herein, can be made to the present disclosure without, however, departing from the protective scope of the accompanying Claims. For example, junction plates include multibore connections. In another example, the subsea control module can be omitted from the interconnection unit and mounted outside from the interconnection unit, closely or remotely. According to another variation (not shown in the drawings) the subsea control module is retrievable. Accordingly, various changes and modifications to the presently disclosed embodiments will be apparent to those skilled in the art. Such changes and modifications can be made without departing from the spirit and scope of the present subject matter and without diminishing its intended advantages. It is therefore intended that such changes and modifications be covered by the appended claims.

The invention claimed is:

1. An underwater hydrocarbon processing facility comprising:

a cluster configured to process fluids including at least one of a liquid and a gas deriving from a hydrocarbon extraction process, the cluster comprising:

at least two modules, each of the modules including:

one fluid processing device, and a plurality of first connection members configured to define an inlet and an outlet for the fluids; and an interconnection unit configured to be set on a bed of a body of water, wherein the interconnection unit does not process the fluids and includes:

a plurality of second connection members defining an inlet and an outlet for the fluids, wherein the second connection members are configured to be operatively coupled to the corresponding first connection members to operatively interconnect said modules, a plurality of pipes each extending between a couple of the second connection members, a plurality of valves configured to enable the interconnection unit to operate with different quantities of modules, and a subsea control module which, upon receipt of signals acquired from the modules:

elaborates the signals acquired from the modules, emits control signals configured to control the modules, and opens and closes the plurality of valves.

2. The underwater hydrocarbon processing facility of claim 1, wherein each of the modules hosts the fluid processing device selected from the group consisting of: a single hydrocarbon pressure boosting device, a multiphase pump device, a liquid pump device, a gas compression device, a scrubber device, a liquid/liquid separation device, a gas/liquid separation device, a solid/water separation device, a heat exchanging device, a water injection pump device, a chemical injection device, a gas treatment device, an oil treatment device, and a water treatment device.

3. The underwater hydrocarbon processing facility of claim 1, wherein the interconnection unit houses a plurality of additional pipes, each one of the additional pipes extending at least from one of the second connection members to another one of the second connection members and configured to operatively convey the fluids between the modules.

4. The underwater hydrocarbon processing facility of claim 1, wherein:

each of the modules comprises a first frame housing the fluid processing device, and the interconnection unit comprises a second frame larger than the first frame to enable to simultaneously arrange the interconnection unit in a face-to-face configuration with each of the plurality of modules.

5. The underwater hydrocarbon processing facility of claim 4, wherein the first frame and the second frame are configured as parallelepipeds.

6. The underwater hydrocarbon processing facility of claim 4, wherein the first frame is configured to be mounted to the second frame and dismounted from the second frame.

7. The underwater hydrocarbon processing facility of claim 4, wherein the first frame and the second frame are configured to be one of: directly mechanically coupled to one another, and indirectly mechanically coupled to one another.

8. The underwater hydrocarbon processing facility of claim 4, wherein the interconnection unit comprises a platform which supports the second frame and is configured to guide each one of the first frames, when lowered onto the platform, in a designated position on a side of the second frame and in close proximity to the second frame to align each first connection member to a corresponding second connection member, wherein the first connection members and the second connection members project from facing lateral sides of the respective first and second frames.

9. The underwater hydrocarbon processing facility of claim 4, wherein the interconnection unit comprises a sledge configured to slide on a platform towards and away from the second frame, the sledge being configured to guide one of the first frames, when lowered on the sledge, in a designated position on a side of the second frame to align each first connection member to a corresponding second connection member of the interconnection unit, wherein the first connection members and the second connection members project from facing lateral sides of the respective first and second frames.

10. The underwater hydrocarbon processing facility of claim 4, wherein the second frame is configured to support the first frame atop the second frame and to guide the first frame, when lowered on the second frame, in a designated position on top of the second frame to align each first connection member to a corresponding second connection member of the interconnection unit, wherein the first connection members and the second connection members project, respectively, from a bottom face of the first frame and a facing top face of the second frame.

11. The underwater hydrocarbon processing facility of claim 4, wherein:

the interconnection unit comprises a plurality of guides posts, and each of the first frames comprises a plurality of guide engaging members configured to mechanically couple the first frame to the interconnection unit.

12. The underwater hydrocarbon processing facility of claim 4, wherein said first connection members are arranged along a first face of the first frame in accordance to a designated interface layout matching with a designated interface layout of the second connection members of the second frame.

13. The underwater hydrocarbon processing facility of claim 1, wherein the interconnection unit comprises:

a plurality of control cables, and a quantity of junction plates configured to connect the control cables to the modules.

14. The underwater hydrocarbon processing facility of claim 13, wherein each of the junction plates comprises a quantity of electrical connectors connected to a corresponding quantity of the control cables.

15. The underwater hydrocarbon processing facility of claim 1, wherein the interconnection unit comprises:

a plurality of tubes configured to convey at least one of: chemicals and hydraulic fluids, and a quantity of junction plates configured to connect the tubes to the modules.

16. The underwater hydrocarbon processing facility of claim 15, wherein each of the junction plates comprises a quantity of tube connectors connected to a quantity of the tubes.

17. The underwater hydrocarbon processing facility of claim 1, wherein the subsea control module is connected to an umbilical.

18. An underwater hydrocarbon processing facility comprising:

a cluster configured to process fluids including at least one of a liquid and a gas deriving from a hydrocarbon extraction process, the cluster comprising:

at least two modules, each of the modules including:

one fluid processing device, a plurality of first connection members configured to define an inlet and an outlet for the fluids, and a module subsea control module configured to control parameters correlated to the process of the fluid processing device; and an interconnection unit configured to be set on a bed of a body of water, the interconnection unit including:

a plurality of second connection members defining an inlet and an outlet for the fluids, wherein the second connection members are configured to be operatively coupled to the corresponding first connection members to operatively interconnect said modules, a plurality of pipes each extending between a couple of the second connection members, a plurality of valves configured to enable the interconnection unit to operate with different quantities of modules, and an interconnection unit subsea control module connected to an umbilical and each of the module subsea control modules, wherein when functioning as a master with the module subsea control modules functioning as slaves, the interconnection unit subsea control module is configured to:

elaborate signals acquired from the at least two modules, emit control signals configured to control the at least two modules, and open and close the plurality of valves.

19. An underwater hydrocarbon processing facility comprising:

a cluster configured to process fluids including at least one of a liquid and a gas deriving from a hydrocarbon extraction process, the cluster comprising:

at least two modules, each of the modules including:

one fluid processing device, a plurality of first connection members configured to define an inlet and an outlet for the fluids, and a module subsea control module configured to control parameters correlated to the process of the fluid processing device; and an interconnection unit configured to be set on a bed of a body of water, the interconnection unit including:

a plurality of second connection members defining an inlet and an outlet for the fluids, wherein the second connection members are configured to be operatively coupled to the corresponding first connection members to operatively interconnect said modules, and an interconnection unit subsea control module connected to an umbilical and each of the module subsea control modules, wherein when functioning as a master with the module subsea control modules functioning as slaves, the interconnection unit subsea control module is configured to receive signals from the at least two modules and control the at least two modules.

* * * * *